US006638142B2

(12) United States Patent
Knecht et al.

(10) Patent No.: US 6,638,142 B2
(45) Date of Patent: Oct. 28, 2003

(54) APPARATUS FOR SHARPENING BLADES

(75) Inventors: Manfred Knecht, Bergatreue (DE); Peter Heine, Bodnegg (DE)

(73) Assignee: Knecht Mashinenbau GmbH, Bergatreute (DE)

( * ) Notice: Subject to any disclaimer, the term of this patent is extended or adjusted under 35 U.S.C. 154(b) by 0 days.

(21) Appl. No.: 09/829,984

(22) Filed: Apr. 11, 2001

(65) Prior Publication Data

US 2001/0029148 A1 Oct. 11, 2001

(30) Foreign Application Priority Data

Apr. 11, 2000 (DE) ..... 100 17 719

(51) Int. Cl.[7] ..... B24B 49/00
(52) U.S. Cl. ..... 451/9; 451/11; 451/10
(58) Field of Search ..... 451/5, 6, 9, 10, 451/11, 45, 296, 307, 308, 259, 268

(56) References Cited

U.S. PATENT DOCUMENTS 4,497,143 A * 2/1985 Mattei
4,843,767 A * 7/1989 Johnson
5,067,378 A * 11/1991 Gerber ..... 83/13
5,098,027 A * 3/1992 McClure et al. ..... 241/101.2
5,868,602 A * 2/1999 Pallman ..... 451/10

FOREIGN PATENT DOCUMENTS

DE 198 36 804 2/2000

* cited by examiner

*Primary Examiner*—Eileen P. Morgan
(74) *Attorney, Agent, or Firm*—Breneman & Georges

(57) ABSTRACT

A device is proposed for sharpening knives in meat-processing machines, which enables a more precise movement of the sharpening tool (4) against the knife to be sharpened (2), in particular automatic control of this process. This is achieved according to the invention by providing a sensor for determining contact between the sharpening tool (4) and the knife (2).

24 Claims, 4 Drawing Sheets

APPARATUS FOR SHARPENING BLADES

BACKGROUND OF THE INVENTION (1) Field of the Invention

The invention pertains to a device for sharpening knives. More particularly the invention provides a sensor for measuring contact between the knife requiring sharpening and the sharpening tool such as a grinding belt, grinding wheel or the like along with the relative movement between the sharpening tool and the knife disposed in a knife mount for positioning the knife.

(2) Description of the Related Art Including Information Disclosed Under 37 CFR 1.97 and 1.98

Sharpening machines are available on the market for sharpening knives in meat processing machines, such as meat grinders, cutters or the like, in which a knife can be sharpened by hand with a respective sharpening tool, e.g., a belt grinder or grinding wheel. Guiding aids for manual sharpening have been disclosed in publication DE 198 36 804, for example, and are used to facilitate manual sharpening while reducing the danger of accidents.

In addition, semiautomatic machines are available on the market for sharpening knives in meat processing machines, in which the contour of the knife, e.g., a cutter knife, is automatically traversed. Since the first so-called advance, i.e., the path traversed until the sharpening tool contacts the knife, varies depending on how worn the cutter knife is, the first advance is initiated manually as before, and the operator determines when to stop the movement of the knife against the cutting tool by his or her sense of hearing.

Since the knives are routinely sharpened after reaching a respective level of wear, and the outer contour of the knives changes dimensions as they experience wear and must therefore be resharpened, there is no fixed reference point for moving the knife against a cutting tool, which is why knives for meat processing machines have heretofore not been automatically resharpened.

Apart from the personnel input, manual or semiautomatic processing is also disadvantageous because movement toward the cutting tool is imprecise. The incidental noises usually prevalent at such processing facilities are highly disruptive to operators relying on their sense of hearing, so that the actual point where contact is made between the sharpening tool and cutting tool is often exceeded. On the one hand, this results in an excessive abrading of the knife, thereby respectively diminishing the service life of both the knife and sharpening tool. In addition, the sharpening tools for sharpening cutter knives are designed precisely in such a way as to move evasively when a certain sharpening pressure is exceeded, i.e., the application force of the knife against the sharpening tool. As a result, when the knife is pressed too strongly against the sharpening tool, the sharpening procedure no longer centers on the cutting edge of the knife, and hence no longer sharpens it.

Therefore, the object of the invention is to propose a device that enables the reliable movement of the sharpening tool against knives of meat processing machines to be resharpened.

SUMMARY OF THE INVENTION

The objects of the invention are achieved by employing a sensor to detect the relative motion between a knife mounted in a knife mount and a sharpening tool. The novel device also measures the power consumed during the cutting operation by employing a motor current monitor. Further advantageous embodiments and applications of the invention include the utilization of a mechanical sensor to measure other parameters such as conductivity or mechanical vibration. The sensor may also be provided to measure pressure or tension to determine the mechanical load on the knife, knife mount and/or the sharpening tool. An additional sensor may be provided for measuring the force between the sharpening tool and the knife. An evaluator can also be provided to evaluate the time dependence I(t) relationship signal of the sensor as illustrated in the accompanying graph in FIG. 3. This time dependence relationship (I)t can be utilized to evaluate sharpening of the cutting edge of the knife as well as the status of the sharpening tool. One way for checking the status of the sharpening tool is to utilize free grinding or the absence of forward feed during measurements of the time dependence (I)t relationship. The device of the invention may also be implemented by providing fully automatic feed for the novel apparatus as well as implementing the invention by operating the novel device utilizing the procedures heretofore described.

Consequently, a device according to the invention is characterized by providing a sensor for detecting contact between the sharpening tool and knife. Contact detection enables automatic movement, in which the sharpening position of the sharpening tool must be precisely set. The above disadvantages, i.e., unnecessary sharpening operations with respectively diminished service life for both the knife and sharpening tool, can thereby be avoided with the sensor according to the invention in semiautomatic machines, in which the knife is clamped and the sharpening process is started manually.

An excessive sharpening pressure, i.e., too great an application force between the sharpening tool and knife, which can cause the sharpening tool to move evasively, can also be avoided with a sensor according to the invention, thereby always ensuring that the cutting edge of the knife is actually sharpened.

In addition, a sensor according to the invention is envisioned to also be used to build a fully automatic device.

Contact between the sharpening tool and knife can be detected in various ways. For example, the current of an electric motor active during the sharpening process can be monitored. One example would be an electric motor that drives the sharpening tool. Contact between the sharpening tool and knife increases the frictional resistance, and hence the load on the motor. During the detection of motor current achievement of a contact point between the sharpening tool and knife manifests itself as a significant increase in current.

The motor current of the advancing device that guides the sharpening tool toward the knife can also be monitored. After the point of contact at which the knife and sharpening tool meet has been reached, a resistance is encountered in the advancing direction, which in turn manifests itself in the load placed on the accompanying electric motor as a rise in current.

One other way to detect contact between the sharpening tool and knife involves observing other secondary effects, e.g., a change in the pressure level of the supplied cooling lubricant. Such a pressure change can be detected by a pressure sensor, or, in another embodiment of the invention, via current detection once again, but this time relative to the pump motor for the cooling lubricant.

In addition, the time dependence of additional secondary effects, and hence the moment of contact between the sharpening tool and knife during the forward feed, can be ascertained during device operation. For example, the vibration behavior of the entire device could be monitored in this way. The conductivity or electrical resistance between the sharpening tool and knife could also be measured to determine when the sharpening tool came into contact with the knife. One other possible way of determining contact between the sharpening tool and knife would be to use a tension and/or pressure sensor, which can be attached to the sharpening tool or its mount, or to the respective knife, to measure the relevant forces. The moment of contact between the sharpening tool and knife inevitably gives rise to a respective mechanical load, which can be detected via the mechanical tension and/or pressure sensor.

The sensor according to the invention can be used to precisely set the advance, i.e., the path traversed by the sharpening tool against the knife. This enables a precise activation for the different advances that might be necessary when sharpening a knife. Advance is here understood as the respective position of the sharpening tool relative to the knife in a machining step, in which the various advances are initiated in sequence to grind a specific cross-sectional profile into the respective knife.

To grind in such a cross-sectional profile in optimal fashion, it is also advantageous if the sharpening pressure, i.e., application force between the sharpening tool and knife to be sharpened, can be precisely set. A sensor array according to the invention can also be used for this purpose without any greater additional effort.

In a particularly advantageous further development of the invention, an evaluator is additionally provided for evaluating the time dependence of the sensor signal. The sharpening process can be monitored and, if necessary, the sharpening pressure or advance can be controlled over this sensor signal time dependence.

Further, information about the status of the sharpening tool can also be gained over the sensor signal time dependence. This is the case in particular during fully automatic operation, since the required change of sharpening tool must either be indicated or automatically executed by the appropriate system.

To check the sharpening tool status, the time dependence of the sensor signal is preferably observed without advancing the sharpening tool. Therefore, the sensor signal is observed during the so-called free sharpening, in which material is ground from the respective knife until such time as the sharpening tool can essentially run freely again. The time dependence of this free sharpening phase can be used particularly well to check the status of the sharpening tool.

The invention is applicable to the most varied types of knives that require sharpening in meat-processing machines. For example, a so-called Wolf grinder wheel, which acts as a stationary counter-knife for a rotating shearing blade in a meat grinder, can be subjected to surface grinding using a device according to the invention, in which a mount must be provided for securing the Wolf grinder wheel in a plane-parallel manner, onto which a grinding wheel is lowered, or which is moved against a grinding wheel.

A so-called cutter knife can also be sharpened with a device according to the invention, in which a cutter knife mount that moves relative to the sharpening tool is advantageously provided for. To this end, a guide unit is preferably provided for a cutter knife mount to guide the cutter knife along stationary sharpening unit, as known for a semiautomatic device available on the market. However, the reverse arrangement would also be envisioned, i.e., a stationary cutter knife mount, along which a sharpening tool, e.g., grinding belt, is passed.

BRIEF DESCRIPTION OF THE SEVERAL VIEWS OF THE DRAWINGS

An embodiment of the invention is shown in the drawing, and will be explained in greater detail with reference to the following figures in which.

DETAILED DESCRIPTION OF THE INVENTION INCLUDING BEST MODE

Figure 1:
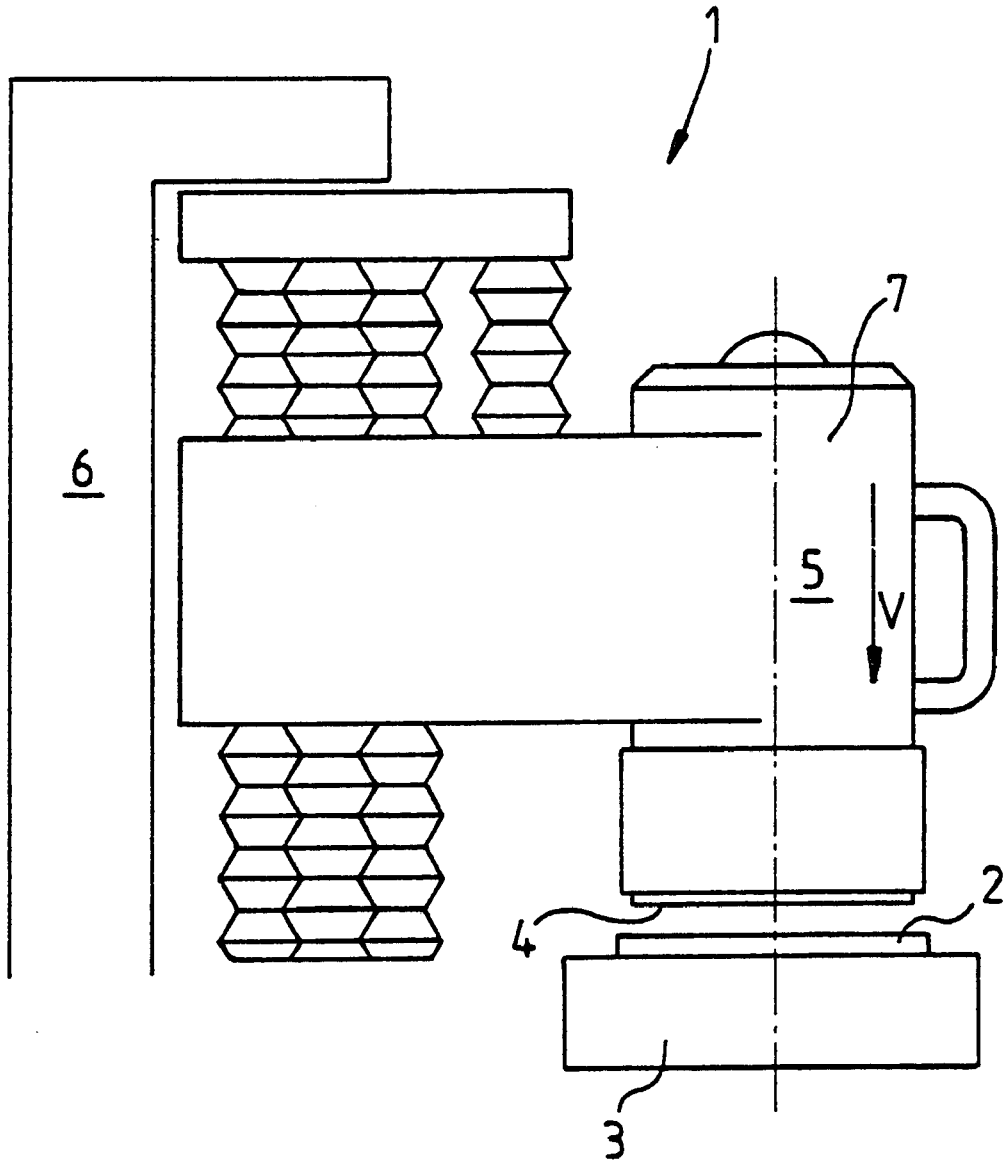
FIG. 1 is a diagrammatic view of a sharpening device according to the invention for surface grinding a Wolf grinding wheel.

FIG. 1 illustrates a sharpening device 1 for surface grinding such as a Wolf grinding wheel 2. The Wolf grinding wheel 2 is the stationary counter-knife in a meat grinder. It is secured in a plane-parallel manner by means of a mount 3 via mounting elements (not shown), e.g., clamped between two jaws.

Situated above the Wolf grinding wheel 2 is a grinding wheel 4 in a grinder 5, which can be lowered on a stanchion 6 in the forward feed direction V. An electric motor 7 here drives the grinding wheel 4. Driving means (not shown) are used for controlled lowering in the forward feed direction V of the grinder 5. Sensor technology for detecting contact between the Wolf grinding wheel 2 and grinding wheel 4 can take the form of determining the time dependence on the electric motor 7 or the drive (not shown) for lowering the grinder 5 during forward feed.

Figure 2:
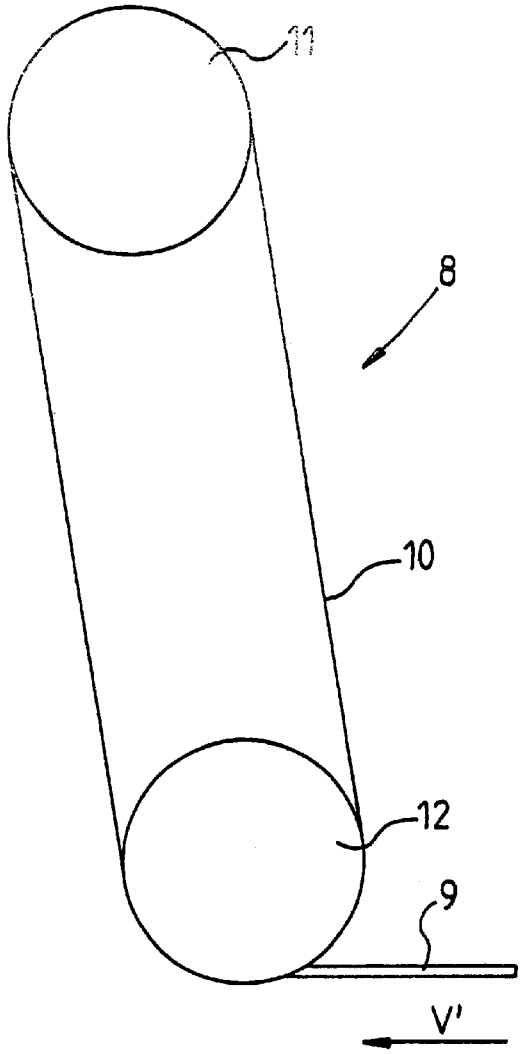
FIG. 2 is a diagrammatic view for sharpening a so-called cutter knife.

FIG. 2 shows a sharpening device 8 for sharpening a cutter knife 9 diagrammatically shown in cross section. The sharpening device 8 has a grinding belt 10, which runs around two idle rolls 11, 12. In a device of this kind, the cutter knife 9, which is secured in a mount not shown in any greater detail, e.g., clamped or screwed, is perpendicularly advanced toward the grinding belt 10 in feed direction V'. In this embodiment as well, the desired sensor technology can be realized by monitoring the motor current of both the motor for driving the grinding belt and the motor for driving the forward feed.

Figure 3:
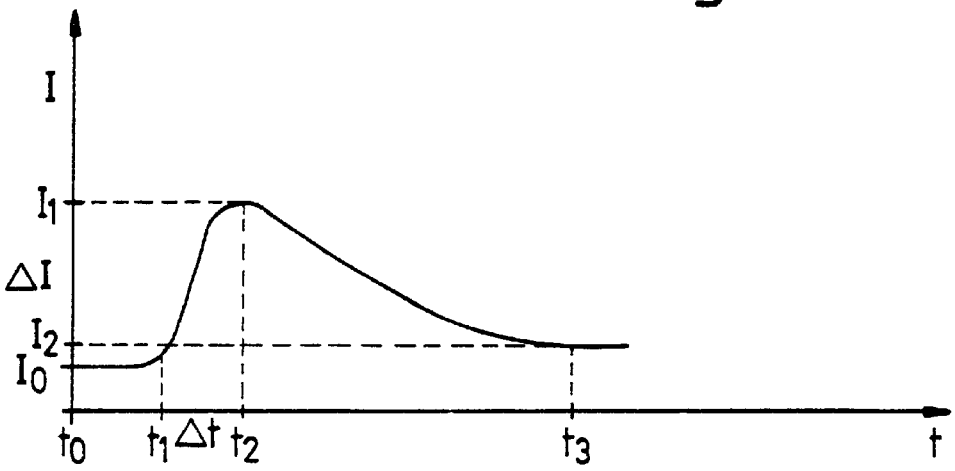
FIG. 3 is a diagrammatic view of a time dependence diagram.

FIG. 3 shows an example of a time dependence diagram measurable for an electric motor of sharpening devices 1, 8 during the forward feed with subsequent stoppage of forward feed starting at a preset application force between the sharpening tool and knife. The motor on which the current I is measured over time can be the drive motor for the sharpening tool, e.g., the electric motor 7 for the grinding wheel 4 or an electric motor for driving the grinding belt 10 (not shown).

The sharpening tool, i.e., the grinding wheel 4 or grinding belt 10, runs freely from time $t_0$ to time $t_1$, so that the operating current of the electric motor is at a low value $I_0$. Contact between the sharpening tool 4 or 10 and the respective knife 2, 9 imparts friction to the sharpening tool 4, 9, thereby increasing the load, and hence the current I.

Therefore, at time $t_1$, the moment of contact between the sharpening tool 4, 10 and knife to be sharpened 2, 9 can be determined.

The current rises with increasing forward feed, until reaching a peak value of $I_1$ at time $t_2$. At this time $t_2$, the forward feed is halted, whereupon current I starts to drop off again slowly. A preset current value $I_2$ is reached at time $t_3$, at which the sharpening tool 4, 10 can freely grind again. The period required to reach time $t_3$ can serve as a gauge for the level of wear of the sharpening tool 4, 10.

In addition, the diagram shows an example of a time interval $\Delta t$ between time $t_1$ and $t_2$, along with a current interval $\Delta I$ between the current $I_0$ and $I_1$. If the status of the sharpening tool 4, 10 is known, the correlation between $\Delta I$ and $\Delta t$ can be used to determine the grinding pressure that arises during advance feed upon reaching the maximum $I_1$, i.e., the application force of the sharpening tool 4, 10 against the knife 2, 9 to be sharpened. The described evaluation options must be regarded as examples; other modes of evaluation are easily conceivable.

Figure 4:
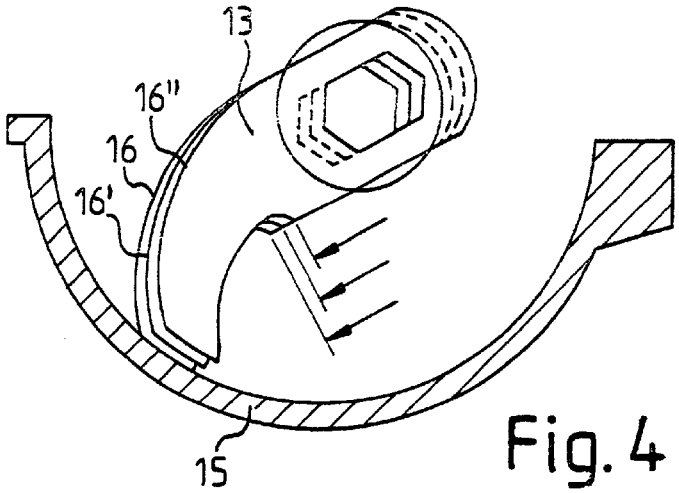
FIG. 4 is a view to illustrate the wear on a cutter knife.
Figure 5:
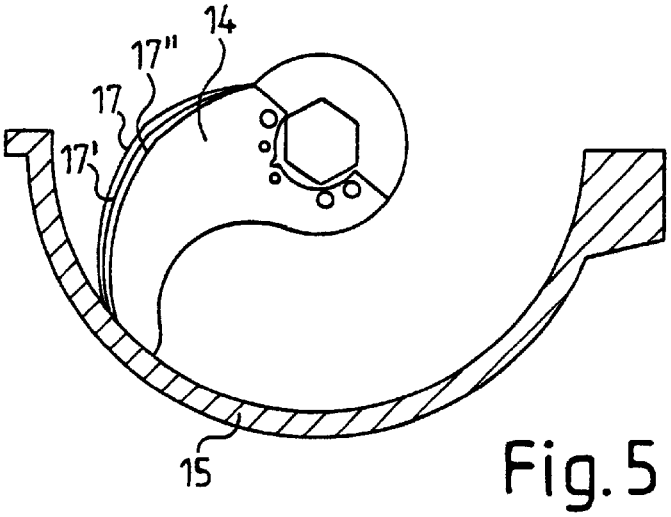
FIG. 5 is a view according to FIG. 4 with another knife shape.

FIGS. 4 and 5 show two different cutter knives 13, 14 in the trough 15 of a cutter. Various zones 16', 16" or 17', 17" are marked in the area of the cutting edge 16, 17, which demonstrate the changing dimensions of the cutter knives 13, 14 with increasing service life and continuing sharpening processes. In the cutter knife 13 according to FIG. 4, the shape of the cutter knife necessitates a readjustment of the rotational axis, so that the cutter knife 13 always abuts the trough 15.

In the shape according to FIG. 5, this axial readjustment is not necessary. Even so, the two shown knife shapes for knives 13, 14 show that no fixed reference points exist for precisely approaching the grinding belt 10, since the knife shape changes with increasing service life.

Figure 6:
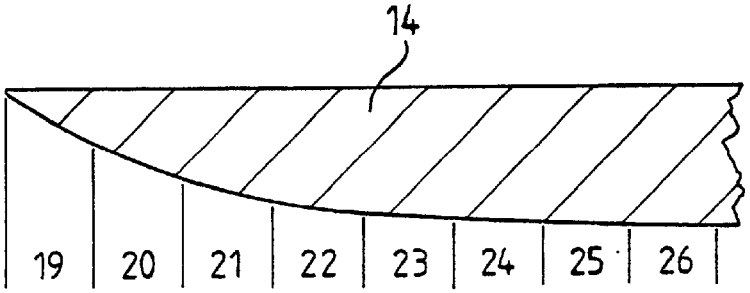
FIG. 6 is a cross-sectional profile of a cutter knife to illustrate the advances necessary for the grinding.

FIG. 6 shows a cross sectional profile through the cutting edge of a cutter knife, e.g., cutter knife 14. Vertical lines show the various advances, 19 to 26, i.e., the consecutive positions in which the knife 14 is moved against the grinding belt 10 for sharpening. This diagram illustrates that such a cutter knife 14 must be sharpened with the most precise advances and forward feeds possible to obtain the desired cross-sectional profile, despite the lack of reference points for moving toward the sharpening tool 10.

In addition to the knife contour, the cross-sectional profile of the cutter knives 13, 14 is also very important for the quality and type of goods produced with the respective set of knives. Various knife shapes with differing cross sectional profiles are used for varying types of sausage, for example. Therefore, the cross sectional profile must be kept as precise as possible even when resharpening.

Figure 7:
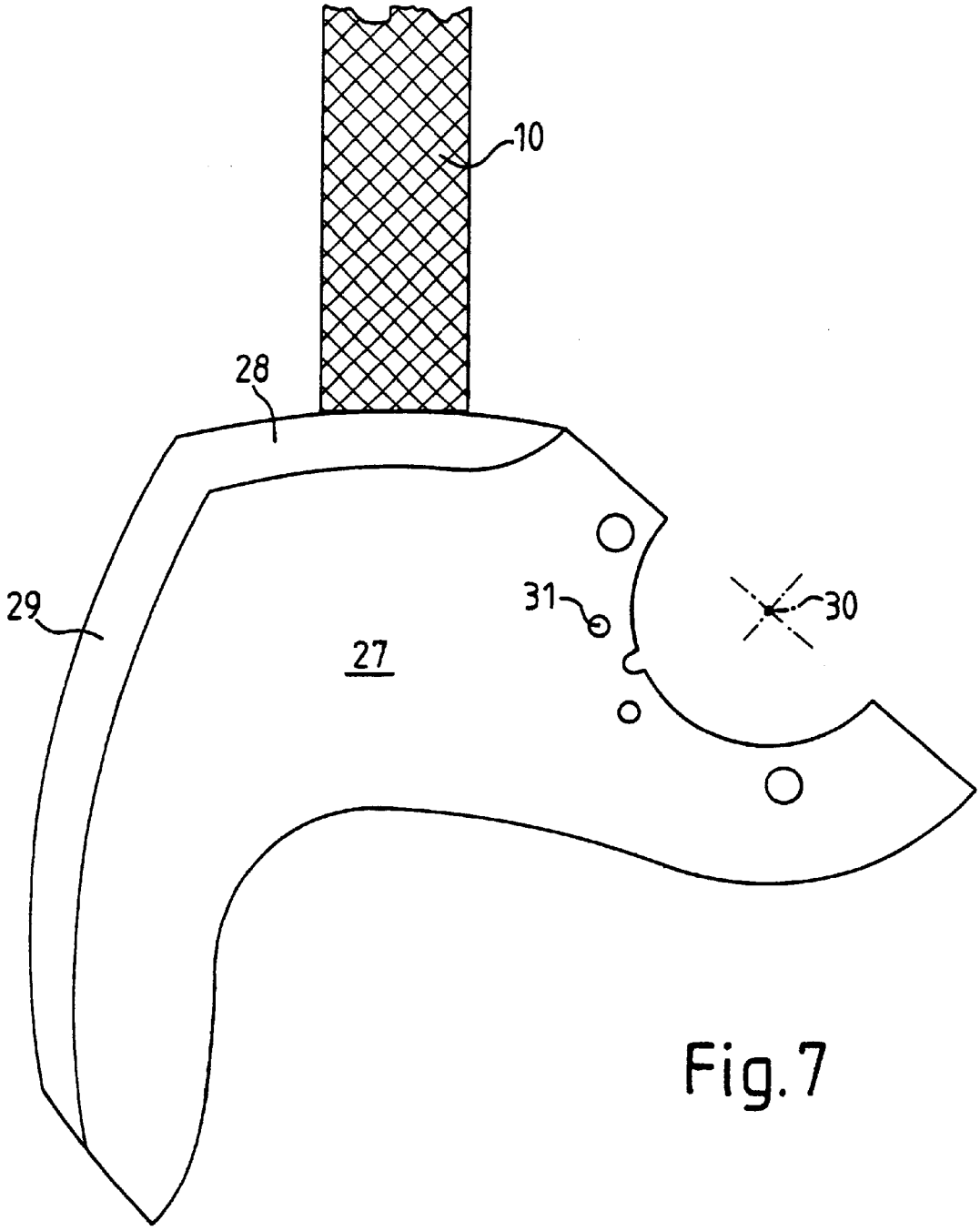
FIG. 7 is a diagrammatic view of another knife shape during the sharpening process.

FIG. 7 shows a cutter knife 27 with two cutting zones 28 positioned at an angle to each other. The grinding belt 10 touches precisely the cutting zone 28 to be sharpened first. In such a knife shape, the varying cutting zones 28, 29 are sharpened consecutively. This means that all advances 19 to 26 in the area of the cutting zone 28 are first executed consecutively, and the cutting zone 29 is then machined accordingly.

This knife shape will again be used to illustrate the difficulties encountered when executing the different advances 19 to 26 of the knife 27 toward the grinding belt 10. There are no reference points for the two cutting zones 28, 29, e.g., relative to the knife axis and/or a fitting hole 31, based on which the forward feed could be controlled. For this reason, these operations were previously set by hand, as mentioned at the outset. The device according to the invention now enables a mechanical, and beyond that a more precise, movement of the knives 2, 9, 13, 14, 27 toward the respective sharpening tool 4, 10.

In addition, it is irrelevant with respect to the application of the invention whether the sharpening tool 2, 10 or the knife to be sharpened 2, 9, 13, 14, and 27 is traversed with the forward feed. The important factor is controlling the relative movement between the knives 2, 9, 13, 14, 27 and the accompanying sharpening tools 4, 10.

The following represents a reference number list of numbers and elements described in this specification:

1 Sharpening device
2 Wolf grinding wheel
3 Mount
4 Grinding wheel
5 Grinder
6 Stanchion
7 Electric motor
8 Sharpening device
9 Cutter knife
10 Grinding belt
11 Idle roll
12 Idle roll
13 Cutter knife
14 Cutter knife
15 Trough
16 Cutting edge
17 Cutting edge
18 Advance
19 Advance
20 Advance
21 Advance
22 Advance
23 Advance
24 Advance
25 Advance
26 Advance
27 Cutter knife
28 Cutting zone
29 Cutting zone
30 Knife axis
31 Fitting hole

What is claimed is:

1. A device for sharpening knives comprising:

(a) a knife clamping device;

(b) a sharpening tool having a variable advance controlled by a monitor that varies advance as a knife mounted in said knife clamping device is being sharpened;

(c) an electric motor for operating said sharpening tool; and (d) a sensor for detecting and measuring the relative motion between a knife mounted in said knife clamping device and said sharpening tool including said monitor for monitoring electric current used by said electric motor for operating said sharpening tool and responsively modifying said variable advance of said sharpening tool in response to current utilized by said electric motor for operating said sharpening tool.

2. The device of claim 1 further comprising a second motor for moving said knife clamping device.

3. The device of claim 2 further comprising a second motor monitor for monitoring the current used by said second motor for advancing said knife clamping device operatively connected to said sensor for responsively modifying said variable advance.

4. The device of claim 1 further comprising a sharpening tool evaluator for evaluating the condition of said sharpening tool.

5. The device of claim 1 or 2 further comprising an evaluator for evaluating the status of the sharpening tool based upon a time dependence I(t) signal from said sensor.

6. The device of claim 1 further comprising means for automatically controlling said variable advance of said sharpening tool in response to said relative motion.

7. The device of claim 1 further comprising means for automatically controlling the movement of said knife clamping device in response to said relative motion.

8. The device of claim 6 or 7 further comprising a vibration, conductivity and/or mechanical sensor.

9. The device of claim 1 wherein said knife clamping device includes a free sharpening time dependence device for checking the status of the sharpening tool.

10. The device of claim 9 further comprising means for automatically controlling the movement of said knife blade in response to said relative motion.

11. The device of claim 9 further comprising means for automatically controlling said variable advance of said sharpening tool in response to said relative motion.

12. A knife sharpening apparatus comprising:

(a) a knife mounting means;

(b) an electric motor for moving said knife mounting means;

(c) a sharpening tool for sharpening a knife mounted in said knife mounting means;

(d) an electric motor for the variable movement of said sharpening tool controlled by a monitor that varies said variable movement as a knife mounted in said sharpening tool is sharpened;

(e) a sensor for measuring the relative movement between said knife mounting means and said sharpening tool;

(f) a monitor for monitoring the current utilized by said electric motor for said variable movement of said sharpening tool and/or said electric motor for moving said knife mounting means; and (g) a free sharpening time dependence device for checking the status of the sharpening tool by free sharpening.

13. The knife sharpening apparatus of claim 12 further comprising a monitor for monitoring current for operating said electric motor for operating said sharpening tool.

14. The knife sharpening apparatus of claim 12 further comprising means for controlling said variable movement of said sharpening tool in response to said relative movement.

15. The knife sharpening apparatus of claim 12 further comprising means for controlling the movement of said knife mounting means.

16. The knife sharpening apparatus of claim 14 or 15 further comprising a pressure measuring sensor for determining the mechanical load on said knife mounting means and/or said sharpening tool.

17. The knife sharpening apparatus of claim 12 further comprising an evaluator for evaluating a time dependence I(t) signal of said sensor for measuring said relative movement and means for checking the status of said sharpening tool.

18. A knife sharpening apparatus comprising:

(a) a knife mounting means;

(b) an electric motor for providing the movement of said knife mounting means;

(c) a sharpening tool having a variable advance controlled by a monitoring device for sharpening a knife mounted in said knife mounting means;

(d) an electric motor for operating said sharpening tool;

(e) a sensor for measuring the relative movement between said knife mounting means and said sharpening tool;

(f) wherein said sensor includes said monitoring device for monitoring electric motor current used by said electric motor for operating said sharpening tool and/or electric motor current used by said electric motor for moving said knife mounting means.

19. The device of claim 18, further comprising means for automatically controlling said movement of said knife mounting means.

20. The device of claim 18 or claim 19 wherein a knife blade is mounted in said knife mounting means.

21. The device of claim 20 further comprising means for automatically controlling said movement of said knife mounting means to said sharpening tool as controlled by a sensor signal generated by using said monitoring device for monitoring the electric motor current for operating said motor for operating said sharpening tool having a variable advance and/or of said electric motor for providing movement of said knife mounting means.

22. The device of claim 18 or 19 further comprising a pressure measuring sensor for determining the mechanical load on said knife mounting means and/or said sharpening tool as controlled by a sensor signal generated by said monitoring device for monitoring the electric motor current used by said motor for operating said sharpening tool and/or of said electric motor for providing movement of said knife mounting means.

23. The device of claim 18 or 19 further comprising an evaluator for evaluating a time dependence I(t) signal of electrical motor current used by said electric motor or operating the sharpening tool and/or of said motor for moving said knife mounting means to generate a sensor signal in a fixed position of said knife mounting means with respect to said sharpening tool without advancement of the knife mounting means.

24. The device of claim 18 or 19 wherein said knife mounting means includes a knife blade clamping device.

* * * * *